US005647315A

United States Patent [19]

Saito

[11] Patent Number: 5,647,315

[45] Date of Patent: Jul. 15, 1997

[54] LUBRICATING ARRANGEMENT FOR ENGINE

[75] Inventor: Tetsushi Saito, Iwata, Japan

[73] Assignee: Yamaha Hatsudoki Kabushiki Kaisha, Iwata, Japan

[21] Appl. No.: 539,124

[22] Filed: Oct. 4, 1995

[30] Foreign Application Priority Data

Oct. 7, 1994 [JP] Japan ..... 6-270620

[51] Int. Cl.[6] ..... F01M 5/00

[52] U.S. Cl. ..... 123/196 AB; 123/195 C; 184/104.2

[58] Field of Search ..... 123/196 AB, 196 A, 123/195 C; 184/104.2

[56] References Cited

U.S. PATENT DOCUMENTS

| | | | |
|---|---|---|---|
| 2,063,436 | 12/1936 | Hild . | |
| 2,852,009 | 9/1958 | Turlay . | |
| 4,155,333 | 5/1979 | Maggiorana . | |
| 4,387,764 | 6/1983 | Lister | 123/196 AB |
| 4,423,708 | 1/1984 | Sweetland | 123/196 AB |
| 4,426,965 | 1/1984 | Patel | 123/196 AB |
| 4,892,136 | 1/1990 | Ichihara et al. | 123/196 AB |
| 5,000,142 | 3/1991 | Aruga et al. . | |
| 5,014,775 | 5/1991 | Watanabe | 184/104.3 |
| 5,074,255 | 12/1991 | Ebesu et al. . | |
| 5,148,784 | 9/1992 | Hiraoka et al. . | |
| 5,363,823 | 11/1994 | Gittlein | 123/196 AB |
| 5,575,329 | 11/1996 | So et al. | 123/196 AB |

FOREIGN PATENT DOCUMENTS

| | | |
|---|---|---|
| 0651141 | 5/1995 | European Pat. Off. . |
| 960326 | 3/1957 | Germany . |
| 4211896 | 10/1993 | Germany . |
| 2231087 | 11/1990 | United Kingdom . |

OTHER PUBLICATIONS

European Search Report dated Jan. 20, 1995.
European Search Report dated Jan. 12, 1996.

*Primary Examiner*—Erick R. Solis
*Attorney, Agent, or Firm*—Knobbe, Martens, Olson & Bear LLP

[57] ABSTRACT

A cooling and lubricating system for an internal combustion engine wherein an oil cooler and oil filter are mounted at a lower portion of the cylinder block in a recess formed by the crankcase member to provide a compact assembly and wherein the oil filter is readily accessible. All of the passages for supplying lubricant and coolant to and from the oil cooler and oil filter are formed integrally in the body of the engine so as to avoid the use of external conduits.

19 Claims, 14 Drawing Sheets

LUBRICATING ARRANGEMENT FOR ENGINE

BACKGROUND OF THE INVENTION

This invention relates to a lubricating arrangement for an engine and more particularly to a lubricating arrangement for facilitating circulation of lubricant through an oil cooler and also for facilitating operation of the crankcase drain of the engine.

It is well known that internal combustion engines require numerous auxiliaries for their operation. These auxiliaries include, in most instances, a lubricating system including a lubricating pump for circulating lubricant through the engine, a cooling system including a cooling pump for circulating coolant through the engine's cooling jackets, and an oil cooler, if one is provided, and various other accessories.

In my copending application entitled "Engine Cooling System," Ser. No. 08/331,052, filed Oct. 28, 1994, and assigned to the assignee hereof, there is disclosed an engine construction arrangement wherein the driving of these auxiliaries and pumps is facilitated. In addition, the number of external conduits required to circulate the lubricant and coolant is reduced by forming these conduits, in major part, in the actual castings of the engine.

This invention relates to an improved feature of that design dealing partially with the oil cooler, its mounting, and how the lubricant and coolant are supplied to the oil cooler.

In engines it is well known that the lubricant, in addition to lubricating the engine, is frequently employed for assisting in the cooling of the engine. Thus, the lubricant gains heat not only through its lubricating function, but also through this cooling function. Since most lubricants have a temperature at which they begin to deteriorate, it is desirable to ensure that the lubricant is cooled so that it cannot exceed that temperature.

Various types of oil coolers have been proposed. Although coolers that operate to exchange heat directly to the air have some advantages, they obviously require external positioning and must be positioned so that air flow can cool the lubricant sufficiently. Thus, liquid-cooled oil coolers have a number of advantages over the air-cooled variety. However, when the engine coolant is utilized for cooling the oil through its oil cooler, then the number of external conduits may be increased.

It is, therefore, a principal object of this invention to provide an improved engine oil cooler arrangement wherein the oil cooler can be mounted in an area where it will be relatively unobtrusive, will still be positioned so as to facilitate servicing, and can be supplied with both lubricant and coolant through internal passages formed in the engine.

It is a further object of this invention to provide an improved oil cooler and oil filter arrangement for an engine that can be conveniently located where the oil filter can be serviced and yet the fluids can be delivered to and from it through internal components of the engine.

In wet sump engines, and even in the dry sump tank of a dry sump engine, the lubricant-receiving member has a drain plug in its lower end through which the lubricant can be drained for the purposes of oil changing, etc. Obviously these drain plugs are positioned at the lowest point in the oil tank so as to ensure that the lubricant can be completely drained.

It is also known that contaminants will enter the oil and may precipitate out in the oil pan. It is desirable to have these contaminants accumulate around the drain plug. This is desirable so that when the oil is changed, the accumulated contaminants can be removed. However, the lubricant is normally returned to the crankcase through drains which are located at points spaced from the drain opening. Thus the contaminants may accumulate in areas where they can not easily be drained along with the lubricant that is being replaced.

It is, therefore, a still further object of this invention to provide an improved arrangement for the drain plug of an engine lubricating system so that the area around the drain plug is in the path of lubricant circulation so as to collect accumulated particles around the drain plug and to permit their removal when the lubricant is changed.

SUMMARY OF THE INVENTION

A first feature of this invention is adapted to be embodied in an internal combustion engine having a cylinder block that forms at least one cylinder bore therein and the lower end of which is closed by a crankcase member that is detachably affixed to the cylinder block. A timing case is formed at one end of the cylinder block and is closed by a timing cover. A combined oil filter mounting assembly and oil cooler is positioned in the lower face of the cylinder block adjacent the timing case and is adapted to detachably mount an oil filter. The oil filter is positioned within a cavity formed by the crankcase member and the timing case so that it can be easily accessed. Openings are formed in the faces of the cylinder block contiguous to the oil filter through which both lubricant and coolant may be circulated for permitting the oil to flow through the oil filter and to permit the engine coolant to circulate through the oil cooler.

Another feature of the invention is adapted to be embodied in an internal combustion engine having a cylinder block forming at least one cylinder bore therein. The cylinder block is closed at one end by a cylinder head for forming a combustion chamber and is closed at its other end by a crankcase member for forming a crankcase chamber for containing lubricant for the engine. A drain plug is detachably received in an opening in a lower area of the crankcase member for draining of lubricant from the crankcase chamber. A return passage is formed at least in the cylinder block for draining lubricant from the cylinder head back to the crankcase chamber. The return passage terminates in a discharge end that is juxtaposed to the drain plug for providing a flow of lubricant toward the drain plug to deliver accumulated particles to this area.

DETAILED DESCRIPTION OF THE PREFERRED EMBODIMENTS OF THE INVENTION

Figure 1:
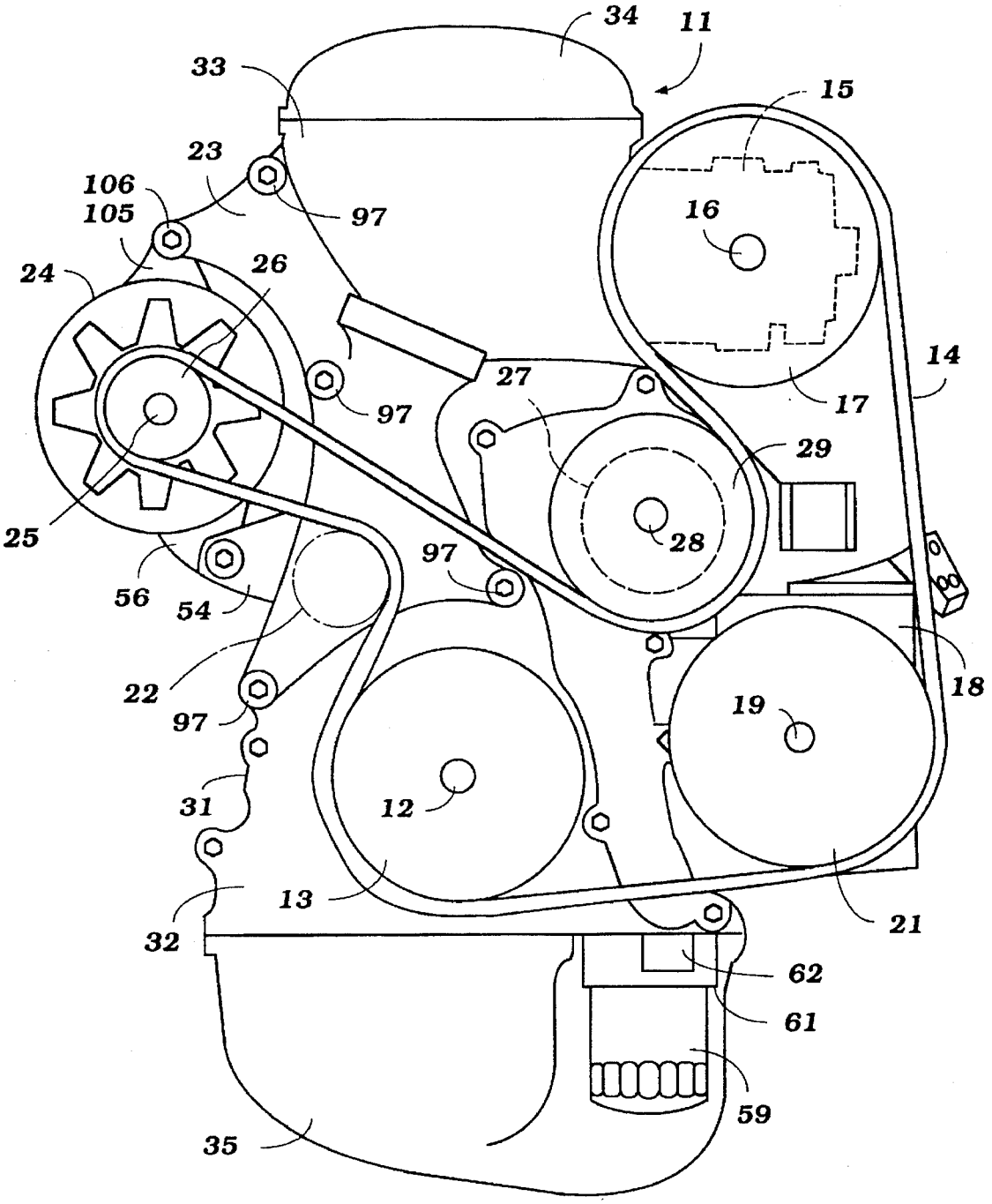
FIG. 1 is a front elevational view of a liquid cooled internal combustion engine constructed in accordance with an embodiment of the invention.

Referring now in detail to the drawings and initially to FIG. 1, an internal combustion engine constructed in accordance with a first embodiment of the invention is shown in front elevational view and is identified generally by the reference numeral 11. In the illustrated embodiment, the engine 11 is of the four cycle, multiple cylinder, in-line type. Although the invention is described in conjunction with an in-line type of engine, it will be readily apparent to those skilled in the art how the invention may be applied to a V-type engine. Generally, the construction as illustrated would be applied to one bank of such a V-type engine, although other applications to V-type engines are possible. The particular number of cylinders employed for the engine 11 is not an important feature of the invention, but it should be noted that the engine 11 is liquid cooled.

As may be seen in FIG. 1, the engine 11 has a crankshaft 12 that extends through the front portion of the body of the engine and which is journaled in the engine in a well known manner. A drive pulley 13 is affixed to the exposed end of the crankshaft 12 and drives a drive belt 14 which, in turn, drives a number of engine accessories. These engine accessories are comprised of a power steering pump 15 that has a drive shaft 16 to which a pulley 17 is affixed. The pulley 17 is driven by the drive belt 14. In addition, an air conditioning compressor 18 is mounted on the Same side of the engine 11 as the power steering pump 15 and has a drive shaft 19 to which a pulley 21 is affixed. The pulley 21 is also driven by the drive belt 14.

An idler pulley, shown in phantom and identified by the reference numeral 22, is mounted on the opposite side of the engine, for example, on an alternator mounting bracket 23, and engages the drive belt 14 to maintain it in engagement with the crankshaft pulley 13. An alternator or generator, indicated generally by the reference numeral 24, is mounted on the alternator bracket 23 in a manner which will be described, and has an alternator shaft 25. A pulley 26 is affixed to the alternator shaft and is also driven by the drive belt 14.

A water pump assembly, indicated generally by the reference numeral 27 and formed in accordance with the construction described in my aforenoted application, is mounted on the front face of the engine 11 in a manner which will be described. This water pump 27 has an impeller shaft 28 to which a pulley 29 is affixed. The pulley 29 is also driven by the drive belt 14.

In order to permit the single drive belt 14 to drive all of the described accessories, it is necessary that their respective pulleys 17, 21, 26 and 29, as well as the idler pulley 22 and the crankshaft pulley 13, to lie in a common plane. The layout of the components of the engine, as will be described, permits this to be achieved.

Figure 2:
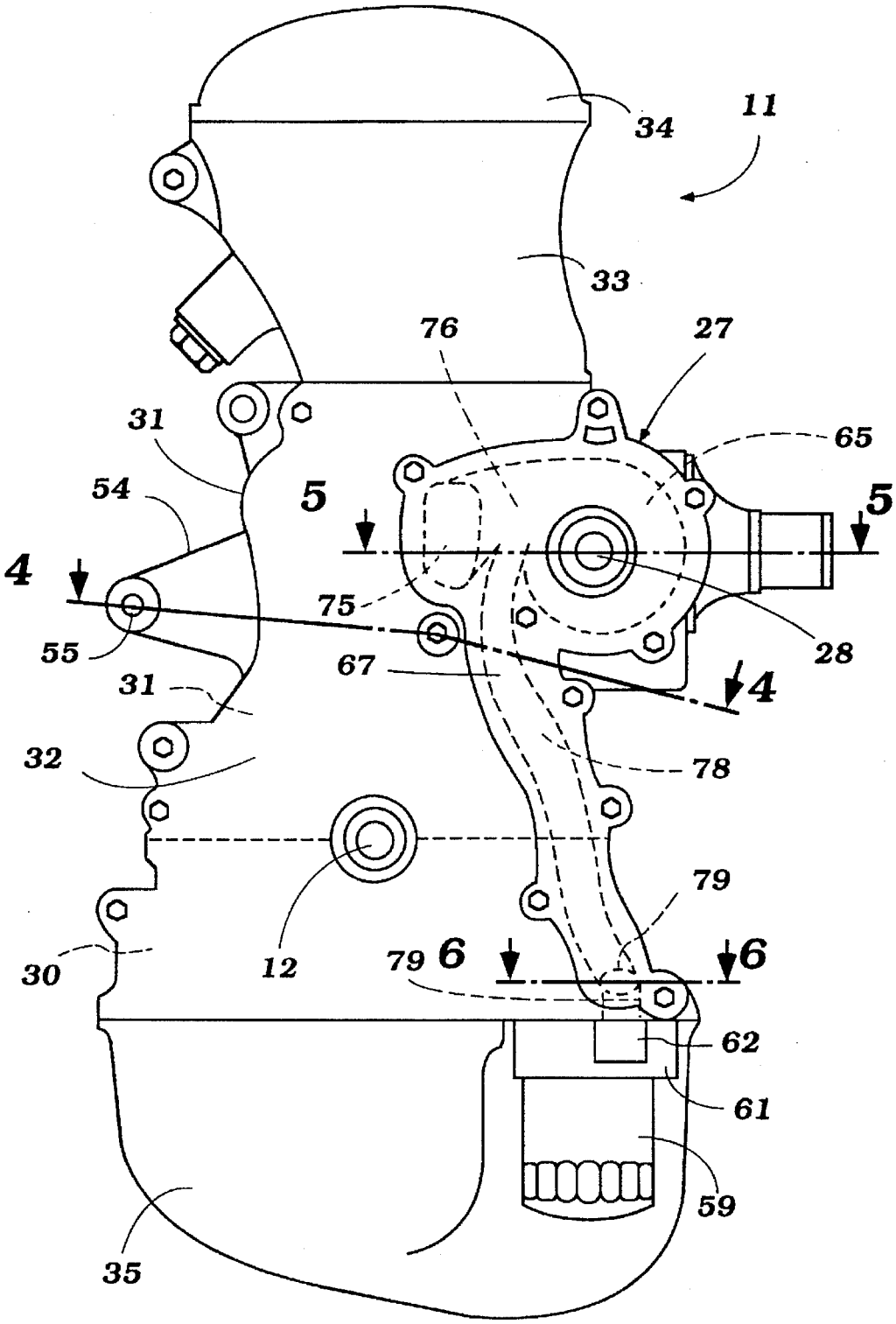
FIG. 2 is a front elevational view, in part similar to FIG. 1, but shows the belt driven engine accessories removed, except for the water pump.

Referring now additionally to FIG. 2, which is a view showing all of the engine driven accessories driven by the belt 14 removed, except for the water pump 27, but the drive pulley 29 of the water pump 27 is removed. In addition, the alternator mounting bracket 23 is removed. It will be seen that the engine 11 is comprised of two major castings, one of which comprises a cylinder block 31 having a front face which is enclosed by a timing chain cover 32 in a manner which will be described. A cylinder head casting 33 is affixed to the cylinder block 31 in a known manner. The cylinder block 32 and cylinder head 33 have internal cooling jackets which crankcase may have generally any known configuration, and only a portion of the cylinder block cooling jacket will be described later.

The lower end of the cylinder block 31 is enclosed by a lower cylinder block member 30 which forms an extension of the cylinder block 31 and a crankcase member 35. The members 30, 31 and 35 are affixed to each other in any suitable manner. They form a crankcase chamber which contain the crankshaft 12 and contains lubricant for the engine 11.

As will become apparent, the engine 11 is of the twin overhead cam type, and the cylinder head 33 mounts a pair of camshafts which are enclosed by a cam cover 34 that is affixed to the cylinder block 33 in a well known manner. This camshaft arrangement and the drive therefor will now be described by reference to FIG. 3, which is a view similar to that of FIG. 2 but, in this view, the timing chain cover 32 has been removed, along with the water pump 27, which is formed integrally with it in a manner which will be described.

The cylinder head 33 has a 5-valve-per-cylinder arrangement, including 3 intake valves (not shown) for each cylinder of the engine which are formed on one side of the cylinder head 33, the left-hand side as seen in the Figures. These intake valves are all operated directly by an overhead mounted intake camshaft 36 that is journaled in a known manner in the cylinder head 33. On the other side of the cylinder head 33, there are provided a pair of exhaust valves (not shown) for each cylinder which are operated by an exhaust camshaft 37, which is also rotatably journaled in the cylinder head 33 in a well known manner.

The intake and exhaust valves may be supported in an orientation of the type disclosed in U.S. Pat. No. 4,660,529, issued Apr. 28, 1987 in the name of Masaaki Yoshikawa, entitled "Four-Cycle Engine," now reissued as Re. 33787, and which patent and reissue are assigned to the assignee hereof. It will be noted that the exhaust camshaft 37 lies closer to the center of the cylinder bore than the intake camshaft 36. Said another way, the intake camshaft 36 is offset outwardly toward one side of the cylinder head 33 more than the exhaust camshaft 37.

The camshafts 36 and 37 are driven in timed relationship relative to the crankshaft 12 at one-half crankshaft speed, as is well known in this art. This timing drive, in the illustrated embodiment, is of the two-stage type and includes a first timing chain 38 which is driven by a sprocket 39 affixed to the crankshaft 12 and within a timing case 41 formed in part by a front face 42 of the cylinder block 31. This timing chain 38 drives a cam driving shaft 43 which is journaled in the cylinder head 33 in a suitable manner and which cam driving shaft 43 is disposed to one side of the cylinder head 33. That is, it is offset closer to the exhaust camshaft 37 than to the intake camshaft 36. A two-stage sprocket 44 is affixed to the cam driving shaft 43, and its larger diameter portion is driven by the timing chain 38.

The smaller diameter portion of the two-stage sprocket 44 is engaged with a second timing chain 45 which, in turn, engages sprockets 46 and 47 affixed to the intake and exhaust camshafts 36 and 37, respectively, so as to drive them. The 2 to 1 speed reduction between the crankshaft 12 and the camshafts 36 and 37 may be derived in any proportion between the sprocket 39, two-stage sprocket 44, and the camshaft sprockets 46 and 47.

Figure 3:
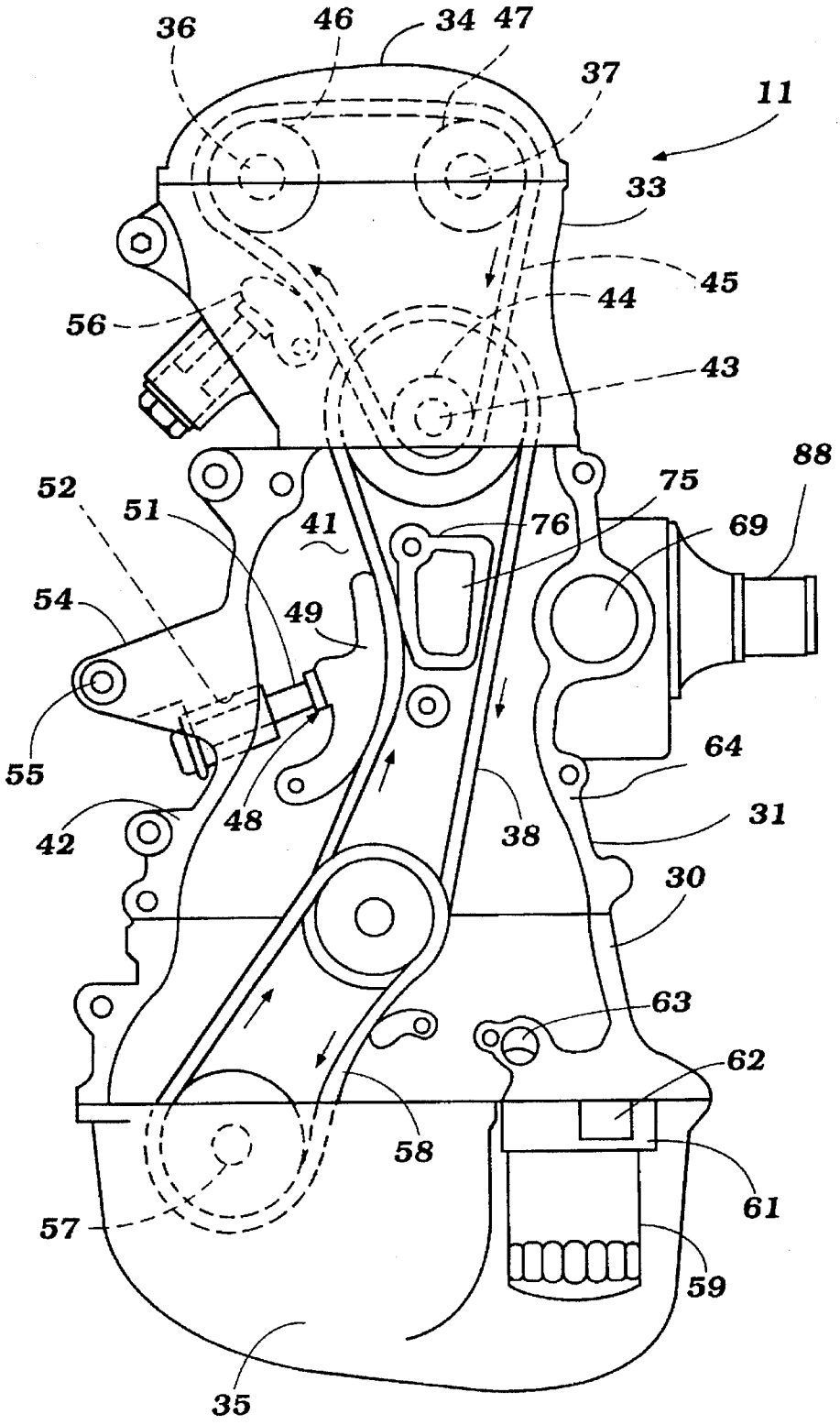
FIG. 3 is a front elevational view, in part similar to FIGS. 1 and 2, and shows the timing case cover also removed.
Figure 4:
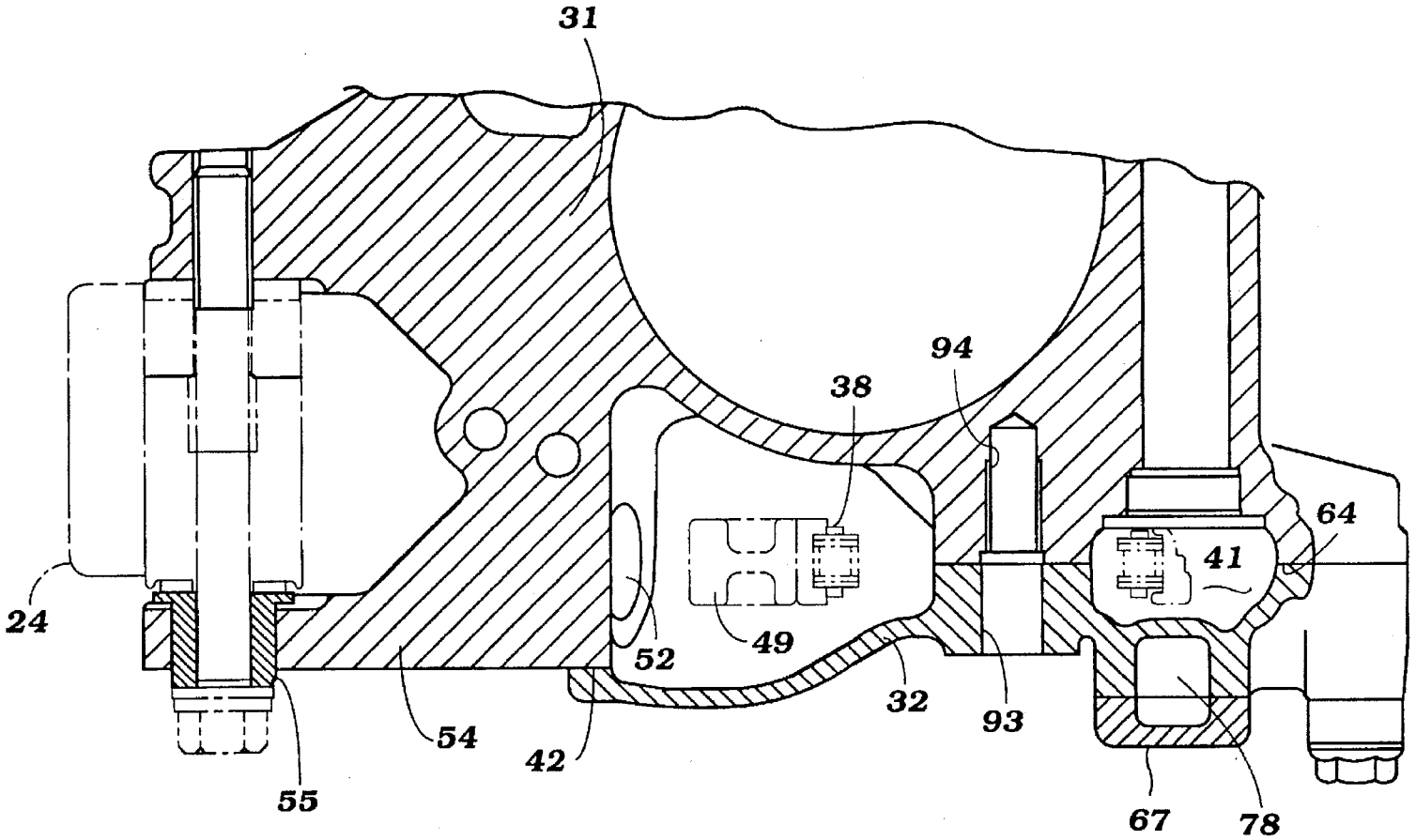
FIG. 4 is an enlarged cross-sectional view taken along the line 4—4 of FIG. 2.

Because the cam driving shaft 43 is offset to one side of the cylinder head 33 and cylinder block 31, it is possible to provide a chain tensioner, indicated generally by the reference numeral 48, on the other side of the timing case 41, as seen in FIGS. 3 and 4. This chain tensioner 48 includes a shoe 49 that is engaged with the slack or return side of the timing belt 38 and which is affixed on a post 51 that extends into a cavity 52 formed in the cylinder block 31 at one side thereof. A coil compression spring places a force on the tensioner shoe 49 and the post 51 is locked in place by a retainer nut 53 so as to maintain the desired tension on the chain 38, as is well known in this art.

The cylinder block opening 52 in which the tensioner mechanism 48 is received is formed adjacent a boss 54 formed on this side of the cylinder block and which receives a mounting post 55 for mounting a lug 56 (FIG. 1) of the alternator assembly 24. The remaining mount for the alternator assembly 24 will be described later.

The offsetting of the cam driving shaft 43 also permits the positioning of a tensioner assembly 56 on the side of the cylinder head assembly 33 adjacent the intake camshaft 36. This tensioner assembly 56 has the same general construction as that associated with the timing chain 38 (tensioner 48), and further description of it is not believed to be necessary.

As has been noted, the engine 11 is provided with a lubricating system, and this includes lubricant which is contained within the crankcase member 35. An oil pump having a pump drive shaft 57 is contained within the crankcase member 35 and is driven by a chain 58 which is, in turn, driven by the crankshaft sprocket 39. Lubricant is circulated in a known manner through the engine lubricating system, and this system includes an oil filter 59 that is surrounded by an oil cooling jacket 61 having a coolant inlet boss 62 to which engine coolant is delivered, in a manner which will be described in conjunction with the description of the cooling system for the engine, including the water pump 27.

The lubricant pump delivers lubricant to the oil cooler 61 and oil filter 59 through an inlet fitting 63 formed in a front face of a flange 64 of the lower portion of the cylinder block and specifically the member 30. Lubricant that has then passed through the oil filter 59 is delivered to the various components of the engine to be lubricated, in any known manner. Basically, except for the water pump and its relationship to the camshaft drive and the other accessory drive and the oil cooler 61, the engine may be of any conventional type. However, the 5-valve-per-cylinder arrangement previously described is a preferred form of the invention.

As may be best seen in FIG. 4, the front faces 42 and 64 are formed by flanges on opposite sides of the timing case 41 are staggered relative to each other. That is, the face 42 lies in a plane that is parallel to but spaced further forwardly than the face 64. The reason for this is to accommodate the water pump structure and to have the driving pulley 29 for the water pump 27 to be disposed in the same plan as the drive pulleys 13, 17, 21 and 26.

Figure 5:
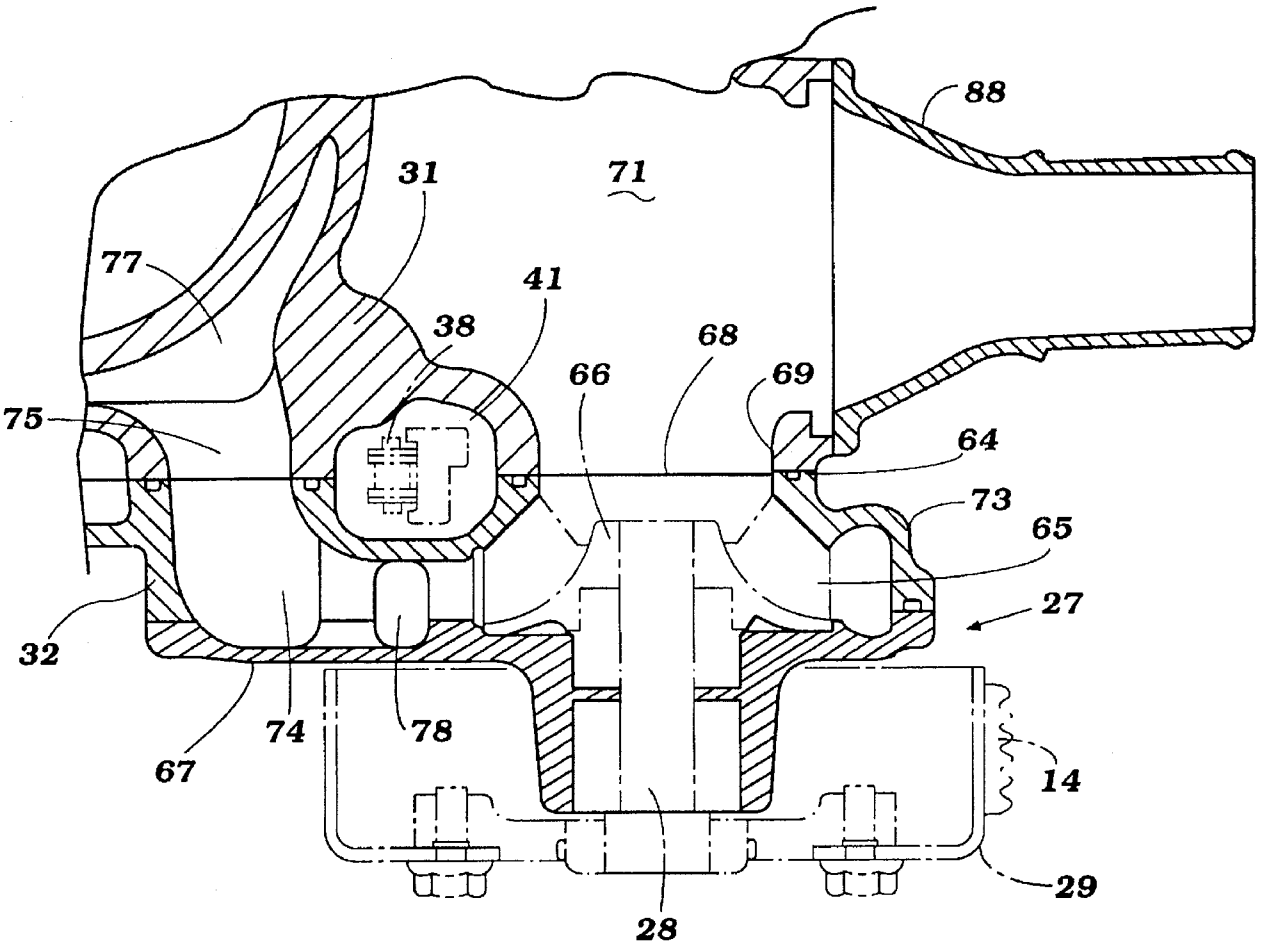
FIG. 5 is an enlarged cross-sectional view taken along the line 5—5 of FIG. 2 and shows the water pump drive pulley and impeller in phantom.
Figure 6:
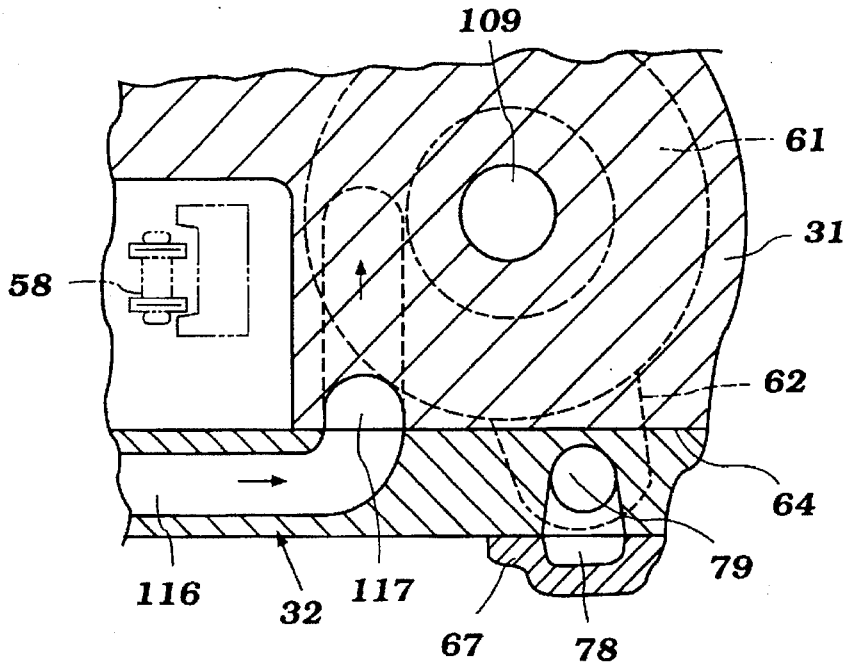
FIG. 6 is an enlarged cross-sectional view taken along the line 6—6 of FIG. 2 and shows certain of the fluid connections to the oil filter and oil cooler.
Figure 7:
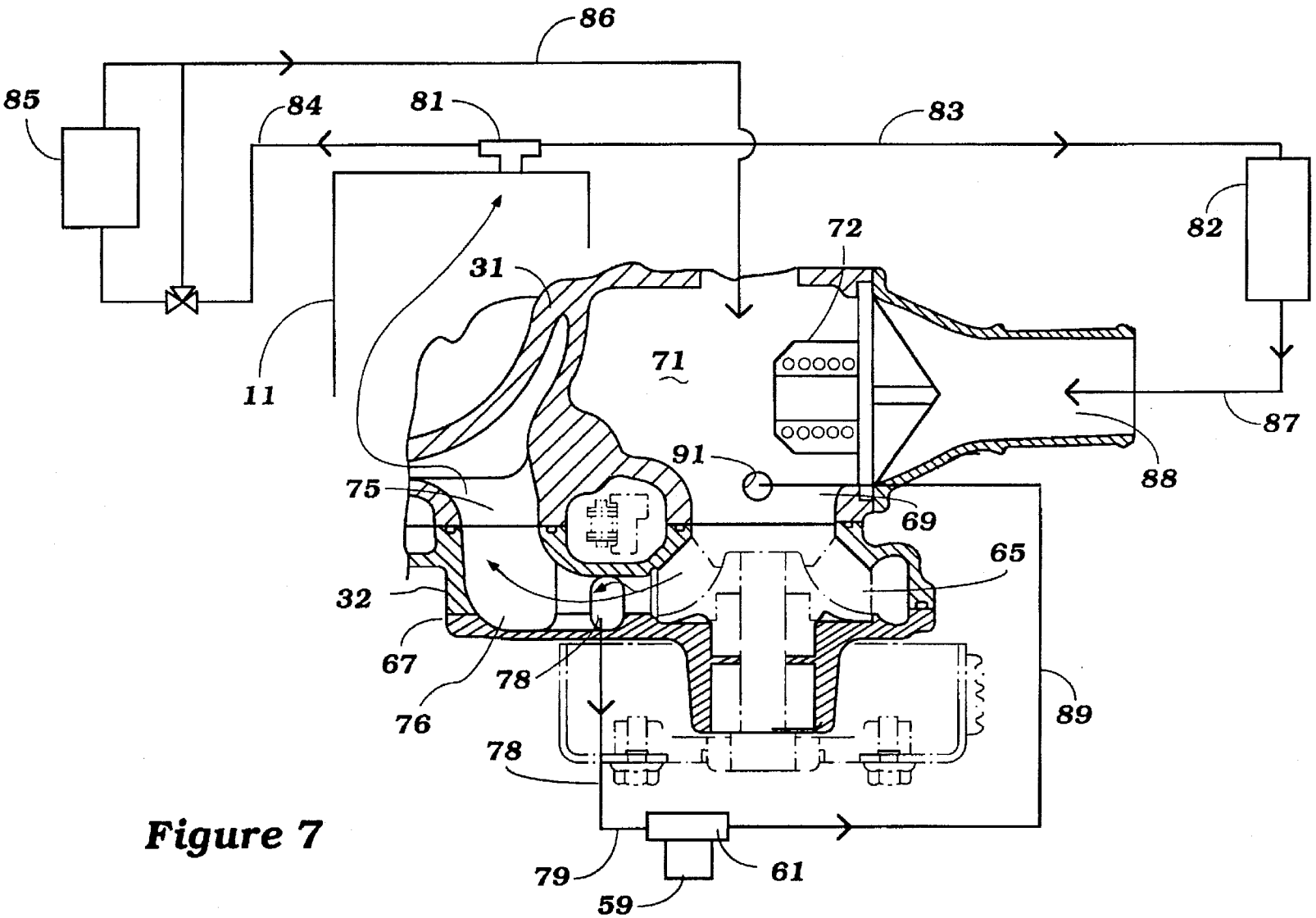
FIG. 7 is a cross sectional view, in part similar to FIG. 5, but shows the remaining components of the liquid cooling system for the engine in schematic fashion.

Referring now primarily to FIGS. 5 and 7, it will be seen that the timing case cover 32 is provided with a cavity 65 that receives an impeller 66 of the coolant pump assembly 27. A coolant pump cover piece 67 is affixed to the timing case cover 32 in an appropriate manner, and provides a journal for the impeller shaft 28 of the coolant pump 27. The rear of the timing case cover 32 is provided with an opening 68 which meets with a corresponding opening 69 (see also FIG. 3) formed in the front of the cylinder block 31 in its face 64 on the outer side of the timing case 41. This opening 69 communicates with a thermostat cavity 71 in which a thermostat assembly 72 is provided. The flow of coolant through the engine will be described later by reference to FIG. 7.

When the impeller 66 is driven by the drive belt 14, coolant will be drawn from the chamber 71 through the openings 69 and 68 and discharged through a scroll portion formed in a protuberance 73 of the timing case cover 32 to a discharge passageway 74 that is formed by the timing case cover 32 and the water pump cover 67. A portion of this coolant will be delivered to the engine cooling jacket through a coolant inlet opening 75 formed in the front face of the cylinder block 31 (see also FIG. 3). It will be seen that this opening 75 is positioned in the timing case portion 41 and is surrounded by the timing chain 38. A flange 76 extends outwardly in sealing relationship with the timing case 32 so as to ensure against coolant leakage.

From the inlet opening 75, coolant flows to the cylinder block cooling jacket, which appears partially in FIGS. 5 and 7 and which is identified by the reference numeral 77. The remaining flow of the coolant will be described later by reference to FIG. 7.

The coolant pump cover 67 and timing case cover 32 form a further coolant passageway 78 (FIGS. 2, 4 and 5) that extends from the passageway 74 downwardly along the front of the engine to a discharge opening that communicates with a passageway 79 formed in the cylinder block lower member 30 and which terminates in the water inlet opening boss 62 of the oil cooler 61.

The coolant flow path will now be described by reference to FIG. 7. As has been noted, the coolant pumped by the coolant pump 27 is delivered to the cylinder block cooling jacket 77 through the inlet 75. This coolant then circulates through the remainder of the cooling jackets of the engine 11 and is discharged through a discharge fitting 81 which communicates with the heat exchanger or radiator 82 through a conduit shown schematically at 83. In addition, a branch passage 84 extends to a heater core 85 of the heating/air conditioning system of the vehicle and this coolant is returned to the cylinder block thermostat cavity 71 through a return conduit 86.

Figure 11:
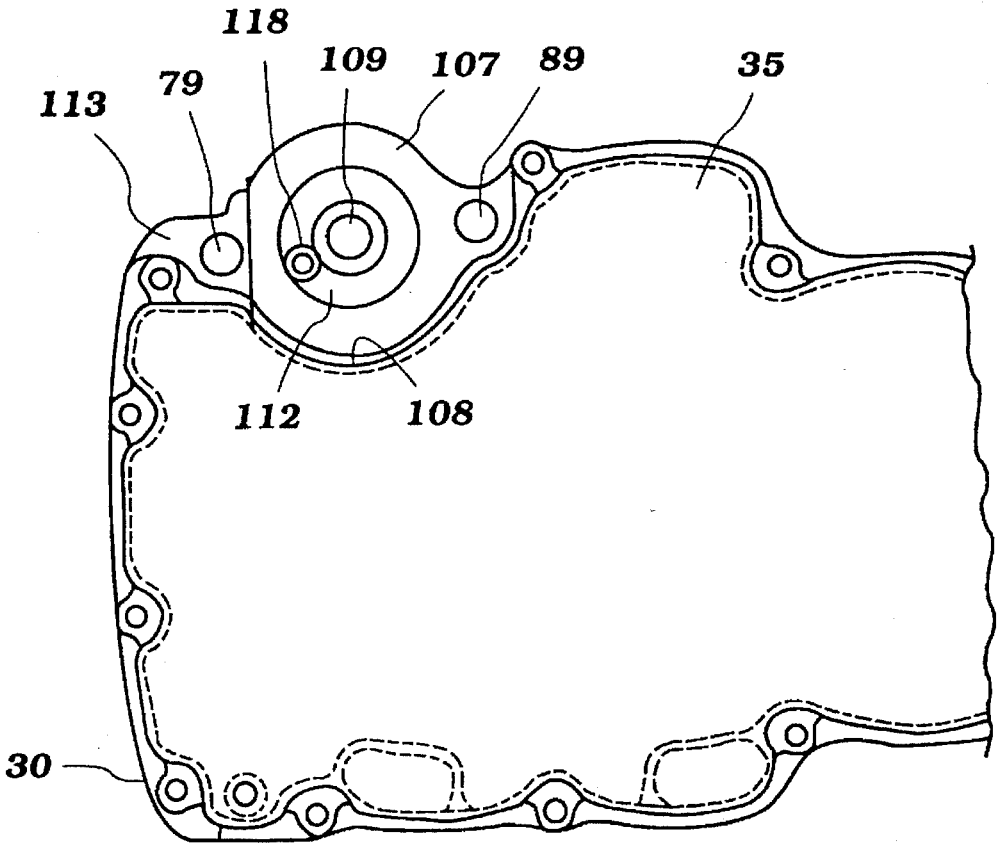
FIG. 11 is a bottom plan view of the area of the cylinder block where the oil filter is mounted, with the oil filter being removed so as to more clearly show the construction.

Coolant from the radiator 82 will flow into the thermostat cavity 71 when the thermostat 72 is opened through a conduit 87 that communicates with a thermostat housing 88 that is affixed to the cylinder block 31 in a well-known manner. The coolant from the oil cooler 61 is returned also to the thermostat cavity 71 of the cylinder block 31 through a conduit shown schematically at 89 and which is formed primarily in the cylinder block 31 and the member 30 and is identified by this same reference numeral therein. The oil cooler 61 has a further boss 90 that communicates the coolant with the lower end of this passage or conduit 89 through an opening formed in the lower face of the cylinder block member 30, as best seen in FIG. 11, wherein the passage 89 clearly appears. The passage 89 of the cylinder block terminates in a port 91 formed in the cylinder block 31 and which communicates with the cavity 72.

Figure 8:
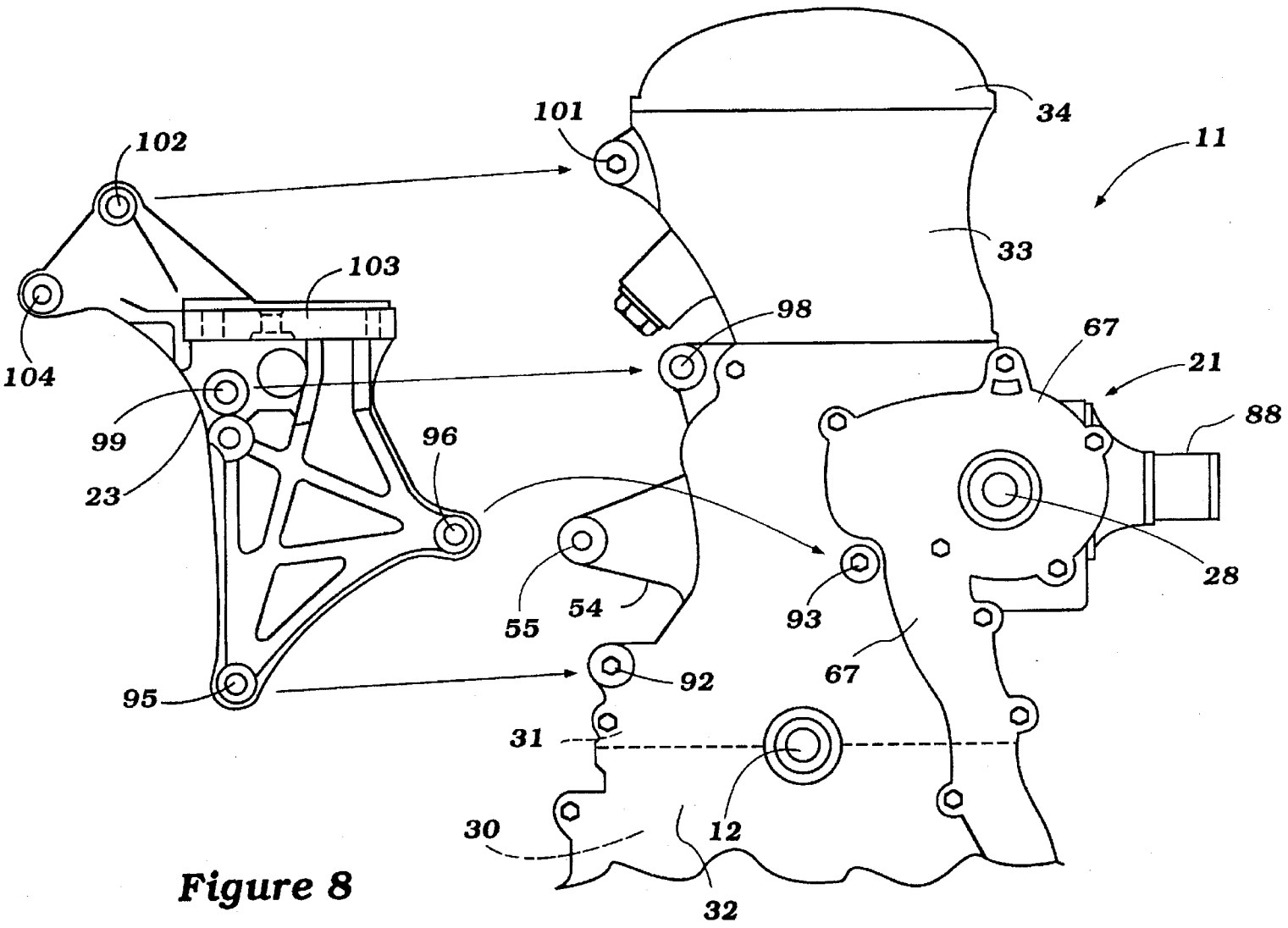
FIG. 8 is a front elevational view, in part similar to FIG. 2, but in partially exploded form, and shows how the alternator mounting bracket is affixed to the front face of the engine.

The mounting arrangement provided by the mounting bracket 23 for the alternator 24 and its attachment to the engine 11 will now be described by reference to FIG. 8, which is an exploded view showing the mounting bracket 23 disassembled from the engine. The timing case cover 32 is provided with a pair of openings 92 and 93 which extend through to the cylinder block 31 and are aligned with tapped openings formed therein, one of which appears in FIG. 4 and is identified by the reference numeral 94, this being the one aligned with the timing cover opening 93. The mounting bracket 23 is provided with bossed openings 95 and 96 that align with the openings 92 and 93, respectively, and which are held to the cylinder block by threaded fasteners 97 (FIG. 1).

The cylinder block forward face 42 is also provided with an opening 98 that is aligned with a corresponding opening 99 of the mounting bracket 23 and which receives a further threaded fastener 97 to affix the mounting bracket 23 in this area. Finally, the cylinder head 33 has a boss in which a tapped opening 101 is formed which is aligned with an opening 102 of the mounting bracket 23 and which receives a further threaded fastener 97 so as to complete the affixation of the mounting bracket 23 to the engine 11. The mounting bracket 23 further has a plate-like portion 103 that extends rearwardly and which permits it and the associated engine 11 to be affixed to the associated vehicle.

The mounting bracket 102 further has an opening 104 that aligns with a lug 105 formed on the alternator 24 so as to receive a threaded fastener 106 so as to affix the alternator 24 to the mounting bracket 23. One of the mountings for the alternator 24 provided for by either the opening 104 or the lug 54 of the cylinder block may be arcuate in shape so as to permit adjustment of the tension on the drive belt 14. Alternatively, drive belt tension may be adjusted by adjusting of the idler pulley 22 referred to.

Figure 9:
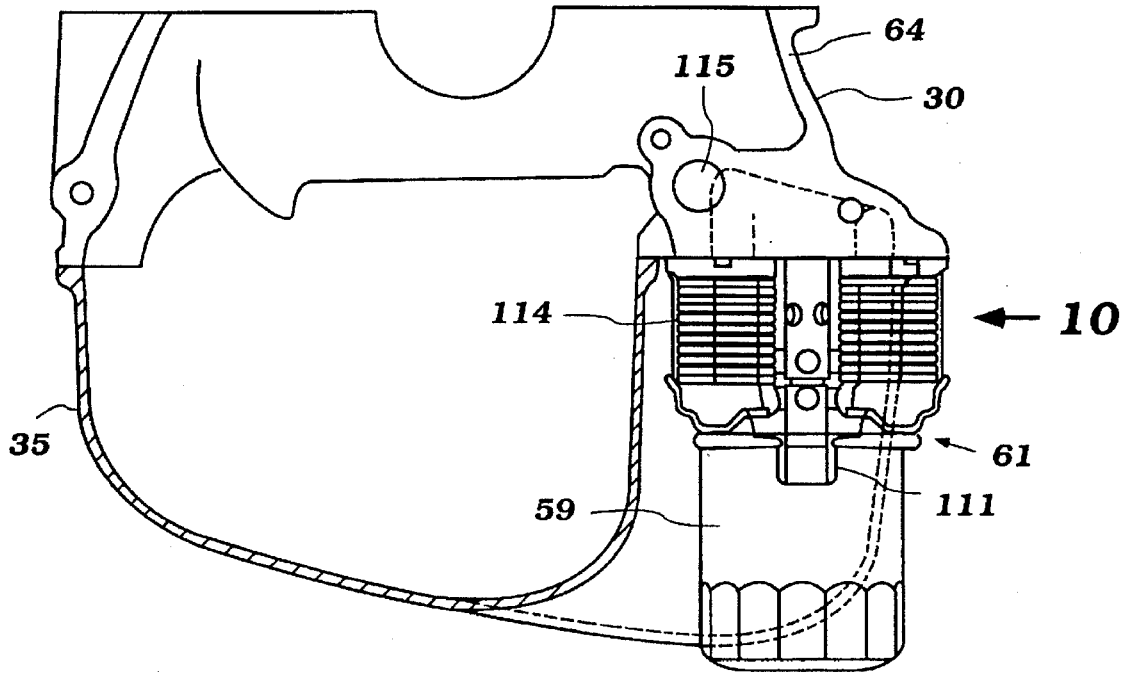
FIG. 9 is a partial view, with a portion of the crankcase member broken away and shown in section, which shows how the oil filter and oil cooler are mounted and the relationship to the oil pan or crankcase member.
Figure 10:
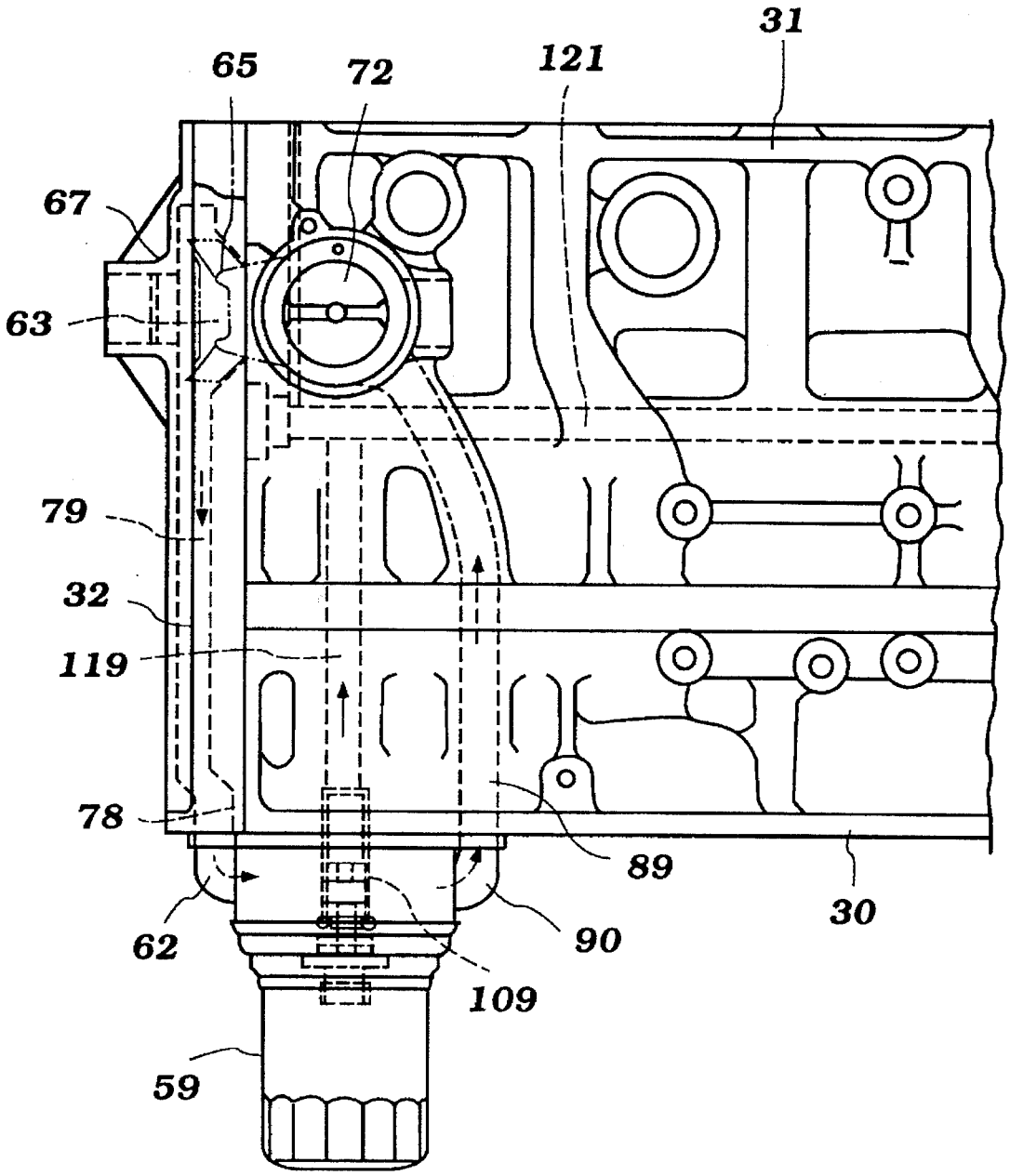
FIG. 10 is a side elevational view looking in the direction of the arrow 10 in FIG. 9 and shows how the lubricant and coolant are circulated through the oil filter and oil cooler.

The mounting arrangement for the oil filter 59 and the oil cooler 61 will now be described in more detail by particular reference to FIGS. 6, 9, 10, and 11. It should be noted that the cylinder block and specifically the member 30 has a lower face 107 that is generally surrounded by a recessed area 108 formed in the oil pan or crankcase member 35. The recess 108 is sized so that the oil filter 59 may be conveniently attached to or detached from the oil cooler 61, and specifically to a nipple portion or opening 109 that extends through the interior of the oil cooler 61 which has a threaded lower portion 111, as best seen in FIG. 9, onto which the female threads of the canister-type oil filter element 59 may be threaded. The opening 109 is surrounded by a sealing surface 112 that is adapted to be engaged by the gasket of the oil filter 59 in a manner well known in this art.

As may be seen in this figure, the surface 107 of the lower portion of the cylinder block has a portion 113 in which the lower end of the coolant passage 79 terminates. Hence, coolant can flow from the engine cooling jacket through a heat exchanger 114 (FIG. 9) formed in the cooling boss 61. This coolant exits, as aforenoted, through the boss 90 and into the cylinder block return passageway 89.

As may be best seen in FIG. 9, the front portion of the cylinder block surface 64 is formed with an opening 115 that communicates with internal passages formed in the cylinder block. In accordance with this embodiment of the invention, the oil pump 57 has a discharge fitting that communicates with an oil delivery passage 116 that is formed integrally in the front cover 32 and which terminates at a discharge opening 117 that communicates with the oil opening passage 115 formed in the cylinder block front surface 64. The oil then flows into the filter through a delivery passage 118 formed in the lower cylinder block surface 107 within the perimeter of the filter sealing surface 112. This oil then flows upwardly from the nipple or opening 109 through a passageway 119 (FIG. 10) formed in the cylinder block 31. This passageway intersects a main oil gallery 121 formed in the cylinder block 31 and which distributes the lubricant to the engine lubricating system. Although any known system may be employed, reference may be had to the copending application entitled "Lubricating System for Engine," filed in the name of Shigenobu Uchiyama, et al., Ser. No. 08/534,566, filed Sep. 27, 1995, and assigned to the assignee hereof (attorney docket no. YAMAH3.059A) for a system which may be employed.

Because of this mounting of the oil filter 59 and the oil cooler 61, it may be readily seen that the use of external conduits for conveying oil and/or cooling water to and from the assembly are avoided. Also, the location of the oil filter 59 is quite close to the oil pump 57, and therefore, the pressure drop of the oil before it reaches the filter will be substantially minimized, as will the drops in the delivery pressure.

Another feature of the lubricating system is the arrangement for returning the oil to the oil pan or crankcase member 35 so as to ensure that contaminants, and particularly solid particles, will collect and be trapped in the area of the drain opening so that they will be discharged when the oil is changed. This structure may be best seen in FIGS. 12 and 13.

Figure 12:
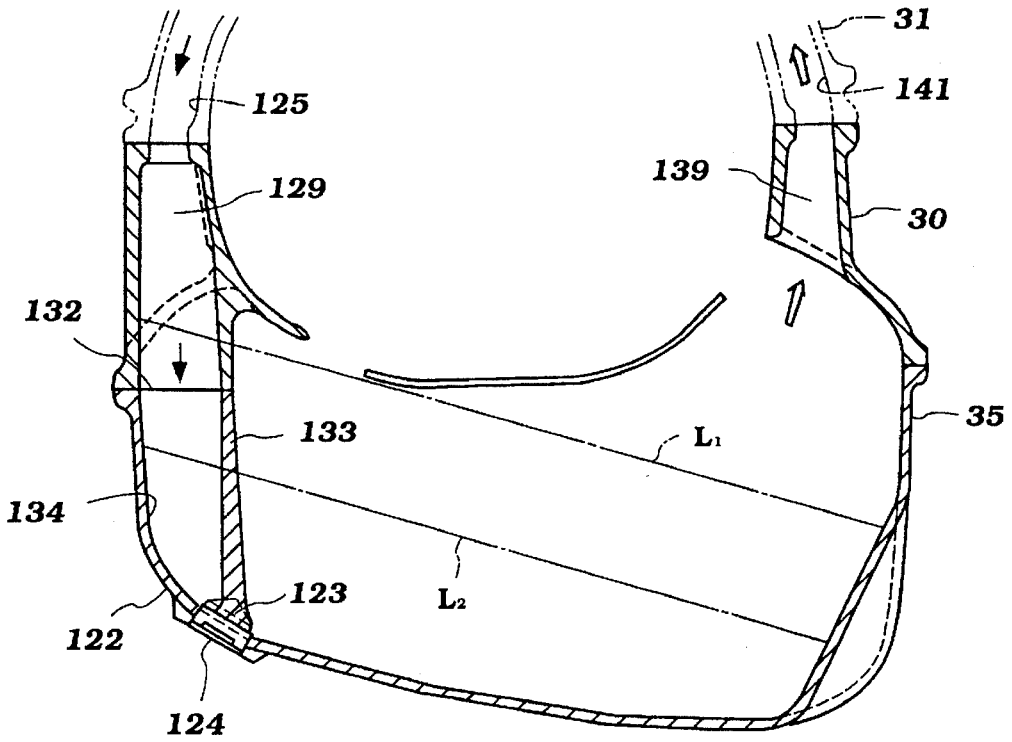
FIG. 12 is a cross-sectional view taken through the crankcase member, showing the cylinder block in cross section and in phantom in the area where the lubricant drain plug is located.
Figure 13:
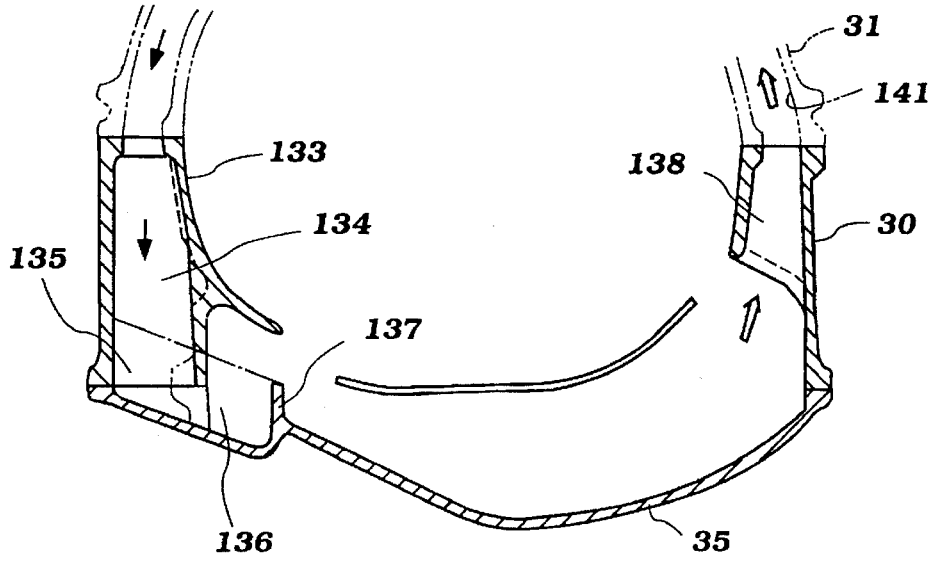
FIG. 13 is a cross-sectional view, in part similar to FIG. 12, and is taken at a position axially spaced from that of FIG. 12 but closely adjacent to it.

In FIG. 12 there are shown two lubricant level lines $L_1$ and $L_2$. It will be noted that these lines $L_1$ and $L_2$ appear inclined to the horizontal in FIG. 12. The reason for this is that the engine 11 is designed so as to be mounted in an associated motor vehicle so that the cylinder block 31 will be canted forwardly from the position shown in the figures. Thus, the lines $L_1$ and $L_2$ indicate the actual oil level in the crankcase member 35 when the engine 11 is actually installed in its normal operating condition.

The level line $L_1$ indicates the oil level when the engine is not running, and the line $L_2$ indicates the level when the engine is running. Under this latter condition, a volume of the lubricant will be maintained in the various lubricating passages of the engine, including the oil galleries already described.

It will be seen that the oil pan or crankcase member 35 has a forward portion, indicated by the reference numeral 122, in which a drain plug opening 123 is formed which is tapped so as to receive a removable drain plug 124. This drain plug 124 is positioned so as to be at substantially the lowest portion of the crankcase member 35, as installed in a vehicle.

The cylinder block 31 is formed with an oil return passageway 125 that returns lubricant from the cylinder head assembly, which has lubricated the camshafts 36 and 37 and the valve mechanism. This communicates with a passageway 126 formed in the lower cylinder block member 30, which as has been noted is interposed between the crankcase member 35 and the cylinder block 31. This passageway 129 terminates at an opening 132, which is in turn aligned with and disposed outwardly of a vertically extending baffle or wall 133 formed in the crankcase member 35. This wall therefore directs the returning lubricant through a channel 134 toward the drain plug 124, and specifically through a lower discharge opening 136 which is juxtaposed thereto.

This drain area is located in a small well 136 formed by a wall 137 of the crankcase member 35. This wall 37 is such so as to ensure that solid particles will accumulate in the well 136. The plug 123 normally closes a path through the wall 133 and the oil and particles must move around through areas shown in FIG. 13. This assists in particle separation. This will ensure that the particles are trapped and will not return to the engine through the lubricating system. These particles will be removed when the oil is changed by removing the drain plug 124 as the opening in the wall 133 normally closed by the dram plug 123 will then be opened so that the particles may easily drain out with the oil.

There is also provided a crankcase ventilating system, and this includes a passageway 138 formed in the crankcase member 35 and which communicates with a similar passageway 139 formed in the lower cylinder block member 30 and a passageway 141 formed in the cylinder block 31. These passageways are above the normal lubricant level in the crankcase, as may be readily seen in FIG. 12, and hence, only gas can be present in this area. This gas, which includes blow-by gas, will be delivered through the internal ventilating system for induction into the combustion chamber through the induction system in any manner known in this art.

Figure 14:
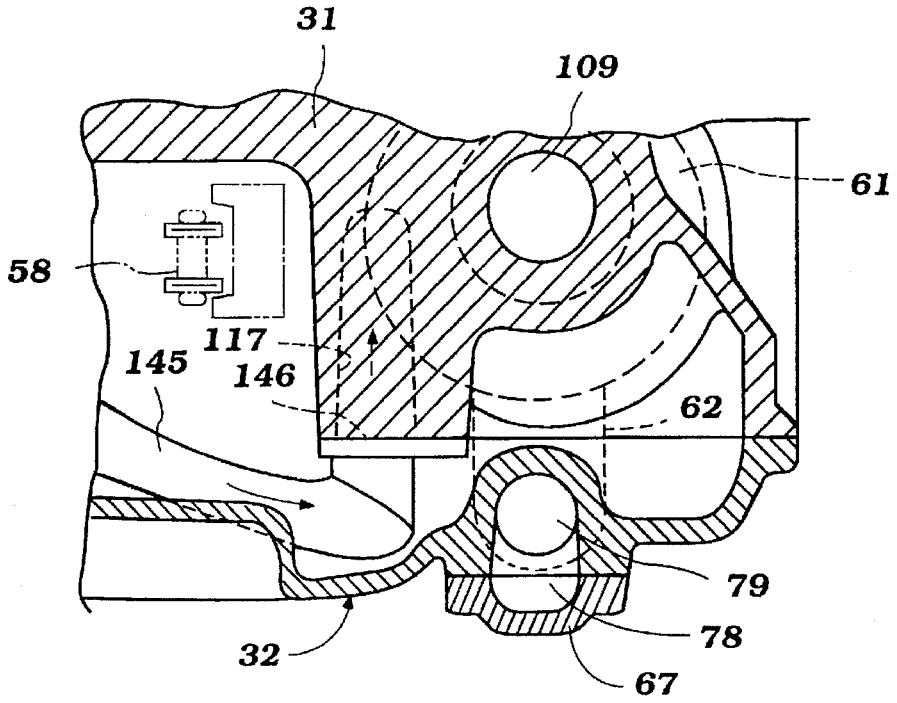
FIG. 14 is a cross-sectional view, in part similar to FIG. 6, and shows another embodiment of the invention.

In the embodiment as thus far described, the oil passageway for delivering oil to the oil filter 59 has been formed by the passageway 117 in the cover 32. If preferred, a separate conduit may be provided for this purpose, and FIG. 14 shows such an embodiment. The only difference between this embodiment and that previously described is this oil delivery system. In this embodiment an oil line 145 extends from the oil pump and terminates in a flange face 146 that communicates with the oil delivery passage 117 of the cylinder block 31. Hence, the front cover of this embodiment may have a simpler construction. However, this requires separate conduits, which are avoided with the previously described embodiment.

Figure 15:
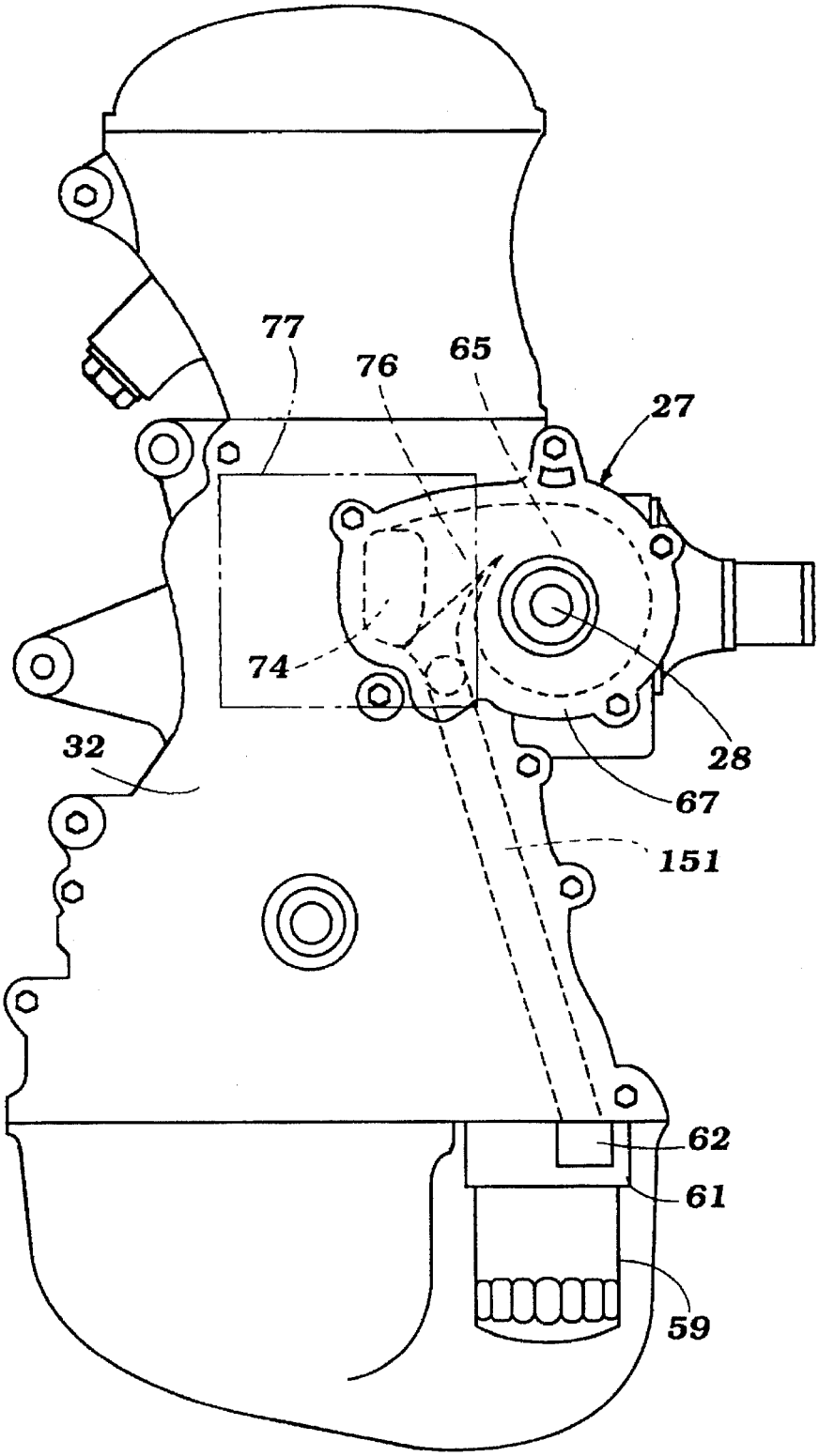
FIG. 15 is a front elevational view, with certain accessories removed, in part similar to FIG. 2, and shows another embodiment of the invention.

In the embodiments of the invention as thus far described, the coolant passage for delivery coolant to the oil cooler 61 was formed at 78 by the timing case cover 32 and coolant pump cover 67. This necessitated the extension of the coolant pump cover 67 to the lower end of the cylinder block 31. FIG. 15 shows an embodiment in which the use of such an extension of the coolant pump cover is not required. In this embodiment, a coolant passage 151 extends from the coolant pump discharge cavity 76 entirely within the timing case cover 32 to the cylinder block water inlet passage 79 that serves the oil cooler 61.

Figure 16:
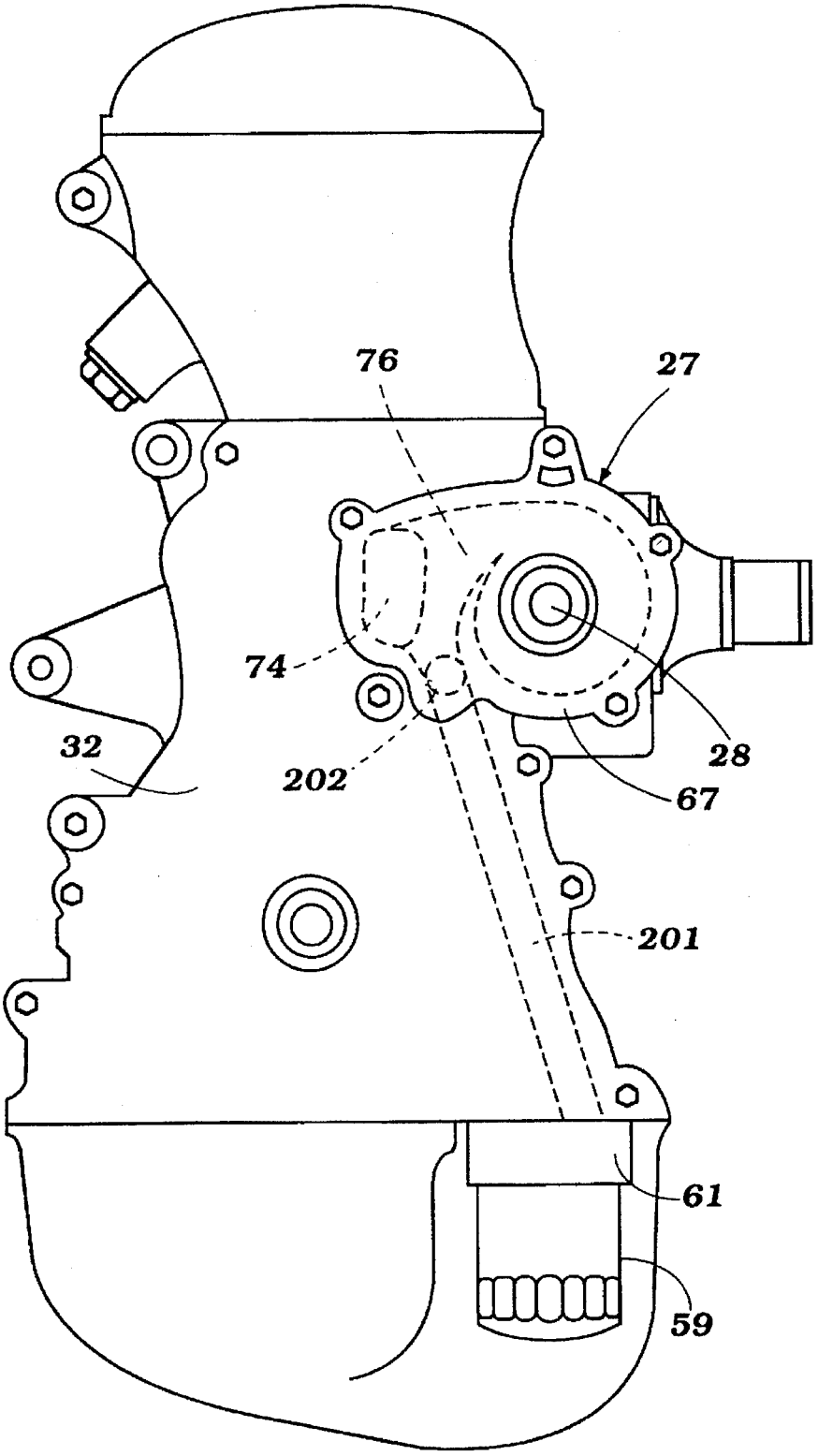
FIG. 16 is a view, in part similar to FIGS. 2 and 15, and shows a still further embodiment of the invention.

FIG. 16 shows another way in which this can be accomplished and in this embodiment, the cylinder block is formed with a passage 201 that extends downwardly to the oil cooler 61. In this case, the boss 62 is not required for the oil cooler 61. The upper end of the passage 201 communicates with a cross-passage 202 that extends through the front face of the cylinder block 31 and which cooperates with a corresponding passage formed in the timing case cover 32 which communicates with the coolant pump outlet passage 76.

It should be readily apparent that the described embodiments of the invention provide a very compact engine construction wherein the number of external conduits for the coolant, the oil filter, and its cooler are reduced, if not totally eliminated. In addition, contaminant accumulation in the area of the drain plug is assured. Of course, the foregoing description is that of preferred embodiments of the invention and various changes and modifications may be made without departing from the spirit and scope of the invention, as defined by the appended claims.

What is claimed is:

1. An internal combustion engine having a cylinder block forming at least one cylinder bore therein, a crankcase member affixed to the underside of said cylinder block and forming a crankcase chamber at the lower end of said cylinder bore, an oil cooler mounted on the lower end of said cylinder block in a recess formed by said crankcase member, an oil filter detachably connected to said oil cooler for receiving oil that has passed through said oil cooler for filtration and returning to said engine for its lubrication, means for delivering coolant for said engine to said oil cooler and returning said coolant to said engine, and means for delivering lubricant from a lubricant pump to said oil filter through said oil cooler and for returning lubricant to said engine for its lubrication.

2. An internal combustion engine as set forth in claim 1, wherein the oil cooler and oil filter are mounted at one corner of the lower surface of the cylinder block adjacent a timing drive mechanism for driving a camshaft from a crankshaft of said engine, which crankshaft is journaled in said crankcase chamber.

3. An internal combustion engine as set forth in claim 2, wherein the oil cooler extends at least in part beneath a front cover that encloses the timing drive mechanism for the camshaft.

4. An internal combustion engine as set forth in claim 3, wherein at least one fluid path to at least one of the oil filter and oil cooler is formed in the front cover.

5. An internal combustion engine as set forth in claim 4, wherein fluid paths for both the coolant and the lubricant to the oil cooler and oil filter, respectively, are formed at least in part in the front cover.

6. An internal combustion engine as set forth in claim 5, further including an oil pump driven by the crankshaft and disposed below its rotational axis on the side of the crankshaft opposite to the oil cooler and oil filter.

7. An internal combustion engine as set forth in claim 6, wherein the return for coolant from the oil cooler and for lubricant from the oil filter to the engine are formed in the cylinder block.

8. An internal combustion engine as set forth in claim 7, wherein a coolant pump for the engine is formed at least in part in the front cover and is driven by the crankshaft, said coolant pump being positioned vertically above said crankshaft axis.

9. An internal combustion engine as set forth in claim 8, wherein the coolant pump is disposed vertically above the oil cooler.

10. An internal combustion engine as set forth in claim 1, wherein the cylinder block and crankcase member are formed with a lubricant return passage for returning lubricant to the crankcase chamber from the engine, said crankcase member being formed with a drain opening at a lower portion thereof closed by a closure plug, said lubricant return being disposed so that lubricant flowing back to the crankcase chamber passes across the drain opening.

11. An internal combustion engine as set forth in claim 10, wherein the oil cooler and oil filter are mounted at one corner of the lower surface of the cylinder block adjacent a timing drive mechanism for driving a camshaft from a crankshaft of said engine, which crankshaft is journaled in said crankcase chamber.

12. An internal combustion engine as set forth in claim 11, wherein the drain opening is positioned on the opposite side of the engine from the oil cooler and oil filter.

13. An internal combustion engine as set forth in claim 12, wherein the cylinder bore is disposed at an inclined angle to the vertical plane, the cylinder bore being inclined toward the side of the engine where the drain opening is located.

14. An internal combustion engine as set forth in claim 13, wherein the oil cooler extends at least in part beneath a front cover that encloses the timing drive for the camshaft.

15. An internal combustion engine as set forth in claim 14, wherein at least one fluid path to at least one of the oil filter and oil cooler is formed in the front cover.

16. An internal combustion engine as set forth in claim 15, wherein fluid paths for both the coolant and the lubricant to the oil cooler and oil filter, respectively, are formed at least in part in the front cover.

17. An internal combustion engine as set forth in claim 16, wherein the return for coolant from the oil cooler and for lubricant from the oil filter to the engine are formed in the cylinder block.

18. An internal combustion engine as set forth in claim 17, wherein a coolant pump for the engine is formed at least in part in the front cover and is driven by the crankshaft, said coolant pump being positioned vertically above said crankshaft axis.

19. An internal combustion engine as set forth in claim 18, wherein the coolant pump is disposed vertically above the oil cooler.

* * * * *